US007168687B2

(12) United States Patent
Thompson

(10) Patent No.: US 7,168,687 B2
(45) Date of Patent: Jan. 30, 2007

(54) SNATCH BLOCK, SNATCH BLOCK ASSEMBLY AND METHOD OF USE

(75) Inventor: Rocke P. Thompson, Clearfield, UT (US)

(73) Assignee: Techxotic LC, Clearfield, UT (US)

( * ) Notice: Subject to any disclaimer, the term of this patent is extended or adjusted under 35 U.S.C. 154(b) by 0 days.

(21) Appl. No.: 10/977,320

(22) Filed: Oct. 29, 2004

(65) Prior Publication Data

US 2006/0091369 A1 May 4, 2006

(51) Int. Cl.
*B66D 3/04* (2006.01)

(52) U.S. Cl. ..... 254/415

(58) Field of Classification Search ..... 254/402, 254/405, 406, 415

See application file for complete search history.

(56) References Cited

U.S. PATENT DOCUMENTS 686,154 A * 11/1901 Smith ..... 254/406
796,366 A * 8/1905 Smith ..... 254/406
2,382,049 A * 8/1945 Frankhouser ..... 254/402
2,449,703 A * 9/1948 Johnson ..... 254/406
2,555,059 A * 5/1951 Schrader ..... 254/406
2,633,329 A * 3/1953 Le Bus ..... 254/406
2,741,458 A * 4/1956 Le Bus, Sr. ..... 254/406
2,754,084 A * 7/1956 Le Bus, Sr. ..... 254/406
3,372,908 A * 3/1968 McCarthy ..... 254/405
3,819,154 A * 6/1974 Miller ..... 254/134.3 PA
3,899,158 A * 8/1975 Johnson ..... 254/405
3,999,739 A 12/1976 Vick et al.
4,056,257 A * 11/1977 Kaiser ..... 254/406
4,325,537 A * 4/1982 Winter et al. ..... 254/405
4,614,332 A 9/1986 Wilson
4,760,993 A 8/1988 Du Preez
5,249,543 A 10/1993 Rutgerson et al.
5,348,116 A 9/1994 Pickering
5,725,200 A 3/1998 Gordon
5,845,894 A * 12/1998 Petzl et al. ..... 254/391
6,244,570 B1 * 6/2001 Habberstad ..... 254/406
6,263,999 B1 * 7/2001 Atkinson et al. ..... 182/5
6,481,695 B1 11/2002 Fuller
6,651,962 B2 * 11/2003 Habberstad ..... 254/406
2003/0111655 A1 * 6/2003 Habberstad ..... 254/415

OTHER PUBLICATIONS

Webpage, http://www.petzl,com, Petzl Sport—Products—PRO TRAXION, Oct. 26, 2004, 1 page.
Webpage, http://www.petzl.com, Petzl Sport—Products—RESCUE, Oct. 26, 2004, 1 page.
Webpage, http://www.bdel.com/gear/rock/pulley.php, Black Diamond Equipment: Gear: Rock: Pulley, Oct. 26, 2004, 2 pages.

(Continued)

*Primary Examiner*—Emmanuel M Marcelo
(74) *Attorney, Agent, or Firm*—TraskBritt

(57) ABSTRACT

Various exemplary embodiments for snatch block and snatch block assemblies are disclosed. A snatch block having a sideplate that is pivotable, enabling a bight of rope, cable, or chain to be inserted is disclosed. The pivotable sideplate may be engaged with a retaining device protruding from an assembly head of the snatch block. The retaining device may be configured to be moved within the assembly head to disengage the pivotable sideplate, enabling the snatch block to be opened. A snatch block assembly may include a rotatable sheave and an attachment structure configured for rotation about an axis substantially transverse to an axis of rotation of the sheave.

23 Claims, 10 Drawing Sheets

OTHER PUBLICATIONS

Webpage, http://www.altrec.com/shop/detail/3684, Northwest River Supplies Yates Rescue Pulley—Altrec.com, Oct. 26, 2004, 2 pages.

Webpage, http://www.onrope1.com, On Rope 1, Oct. 25, 2004, 2 pages.

Snatch Blocks, Blocks—Special Purpose, Ronstan, pp. 46-48.

Webpage, http://www.apsltd.com/Tree/d3000/e242.asp, APS—Snatch Blocks & Magic Boxes, Oct. 26, 2004, 3 pages.

Webpage, http://www.smcgear.net/swivel.htm, SMC Rescue Swivel, Oct. 25, 2004, 1 page.

Webpage, http://www.mtntools.com/cat/bigwall/pulley/petzlswivel.htm, Petzl Rescue & Haul Bag Swivel—Mountain Tools, Oct. 25, 2004, 1 page.

* cited by examiner

SNATCH BLOCK, SNATCH BLOCK ASSEMBLY AND METHOD OF USE

BACKGROUND OF THE INVENTION

1. Field of the Invention

The present invention relates to an improved snatch block having a movable sideplate, a snatch block assembly and a method of using a snatch block to enable installation or removal of a rope.

2. State of the Art

A snatch block is a pulley-block that can be opened to receive a bight of a rope. Generally, a block refers to a pulley or a system of pulleys set in a casing. Conventionally, the casing is provided with a hook, eye, or strap, by which it may be attached to another structure. A pulley is a simple machine consisting essentially of a wheel with a grooved rim in which a pulled rope or cable can be run to change the direction of a force applied to the rope or cable to move a load. The wheel may be a sheave that rotates on a bearing. A sheave refers to a wheel or disk with a grooved rim.

Pulleys are used for various applications in many different activities, especially those activities employing ropes or cables. Pulleys may be used for outdoor recreational activities, such as rock climbing, mountaineering, caving, and mountain rescue work. However, pulleys are also employed in applications, such as in sailing and other marine applications, in urban and industrial rescue work, in safety restraints used in urban and industrial settings, in lifting and material handling in urban and industrial settings, in law enforcement, in tree climbing, and in military applications, among many others. The foregoing activities will be referred to herein generally as "rigging applications."

FIG. 1 illustrates a conventional swing-sided pulley 100 as used with outdoor recreation activities. A first sideplate 10 pivots with respect to a second sideplate 20 about an axle 45. This provides access to a sheave 50 for inserting a bight of a rope (not shown). An opening 30 of the first sideplate 10 and an opening 35 of the second sideplate 20, when aligned, provide an attachment point for a carabiner, also known as a snap-link (not shown). Attaching a carabiner through the aligned openings 30, 35 prevents the first sideplate 10 from pivoting with respect to the second sideplate 20, and holds the rope in place between the first sideplate 10 and second sideplate 20. The swing-sided pulley 100 must be detached from the carabiner to insert or remove the bight of rope. Additionally, the swing-sided pulley 100 can only be attached to another structure in a single plane; that is, the sheave does not swivel with respect to the attachment point.

FIGS. 2A and 2B illustrate a snatch block assembly 15 for the lifting and material handling industry, described in U.S. Pat. No. 6,481,695, assigned to The Crosby Group, Inc. of Tulsa, Okla. The snatch block assembly 15 includes a fixed sideplate 12 and a swing sideplate 14. A nut 40 supports a swivel hook 42 from a trunnion 38. Support means 16 holds the fixed sideplates 12 and the swing sideplate 14 apart and supports a sheave member 18 over which a rope (not shown) will be threaded. When it is desired to replace a rope, bolt head 62 is turned to loosen threaded bolt 60 from the swing sideplate 14. Once the threads are free, the threaded bolt 60 may be moved axially in direction A until the swing sideplate 14 is free to swing to one side to permit the looping of the rope bight through the snatch block assembly 15. It is contemplated that a hammer may be used to loosen the bolt head 62. Turning a tight, threaded bolt may be cumbersome and awkward, slowing many rigging activities. In addition, this operation requires two hands of a user to place the snatch block assembly 15 in a configuration to receive a rope. Especially in a rescue situation, where speed is essential and the user may require one hand to ensure his or her own safety, this requirement may have potentially disastrous consequences.

In view of the foregoing, it appears that a snatch block having a quick and straightforward sideplate opening and closing mechanism is needed. A robust and simple, easily operable snatch block assembly having such a sideplate configuration and further configured to swivel with respect to an attachment point to another structure would also be useful.

BRIEF SUMMARY OF THE INVENTION

The present invention, in a number of embodiments, includes snatch blocks and snatch block assemblies that may be opened to receive a bight of rope, line, cable or other similar elongated element.

In an exemplary embodiment of the present invention, a snatch block comprises an assembly head, one sideplate fixed to the assembly head, a pin projecting from the first sideplate, and another sideplate configured for a pivot action with respect to the assembly head about the pin to open the snatch block for insertion of a bight of rope between the sideplates. A sheave may be mounted between the sideplates for rotation about the pin. A retaining mechanism carried by the assembly head is configured for engaging the another sideplate to prevent the pivot action and retain the another sideplate to the assembly head. The retaining mechanism may be resiliently biased, releasable with a single motion, for example by a single, substantially linear motion of a digit of a user's hand against the resilient bias, and rotationally operable by one hand of a user. Thus, the another sideplate may be released for pivotal movement and pivoted by the user to an open position with one hand to enable insertion or removal of a bight of rope between the sideplates. Similarly, the another sideplate may be pivoted back to a closed position and engaged by the retaining mechanism with one hand.

The retaining mechanism may comprise, for example, a spring-loaded button, or a resiliently biased pivotable latch, which may be configured as a hook-shaped latch. An aperture or a notch formed in the another sideplate may be configured to engage with the retaining mechanism.

An exemplary snatch block assembly of the present invention comprises an assembly head, one sideplate fixed to the assembly head, a pin projecting from the first sideplate, and another sideplate configured for a pivot action with respect to the assembly head about the pin. A retaining mechanism carried by the assembly head is configured for engaging the another sideplate to prevent the pivot action; the retaining mechanism is releasable with a single motion such as, for example, contact by a digit such as a thumb or finger of a user, to enable the pivot action. A sheave may be mounted between the sideplates for rotation about the pin, and an attachment device or structure attached to the assembly head may be configured to swivel with respect to the assembly head about an axis which may be substantially transverse to the axis of rotation of the sheave about the pin.

A snatch block including a plurality of sheaves is also encompassed by the present invention.

The present invention also encompasses a method of use of the snatch block and snatch block assembly of the present invention.

These features, advantages, and alternative aspects of the present invention will be apparent to those skilled in the art from a consideration of the following detailed description taken in combination with the accompanying drawings.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

The present invention, in a number of embodiments, includes a snatch block having one sideplate that is pivotable with respect to another, enabling insertion or removal of a bight of rope, cable or chain between the sideplates. A snatch block assembly may include a rotatable sheave and an attachment device or structure that swivels about an axis of rotation different than, such as substantially transverse to, an axis of rotation of the sheave.

Figure 1:
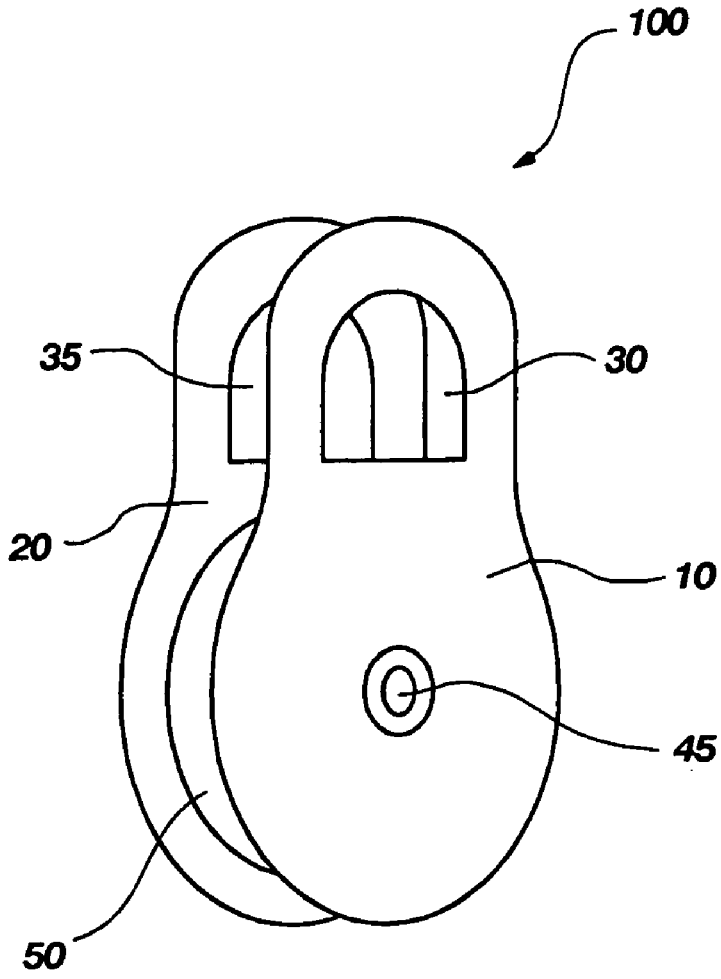
FIG. 1 (PRIOR ART)
FIG. 1 illustrates a conventional swing-sided pulley.
Figure 2A:
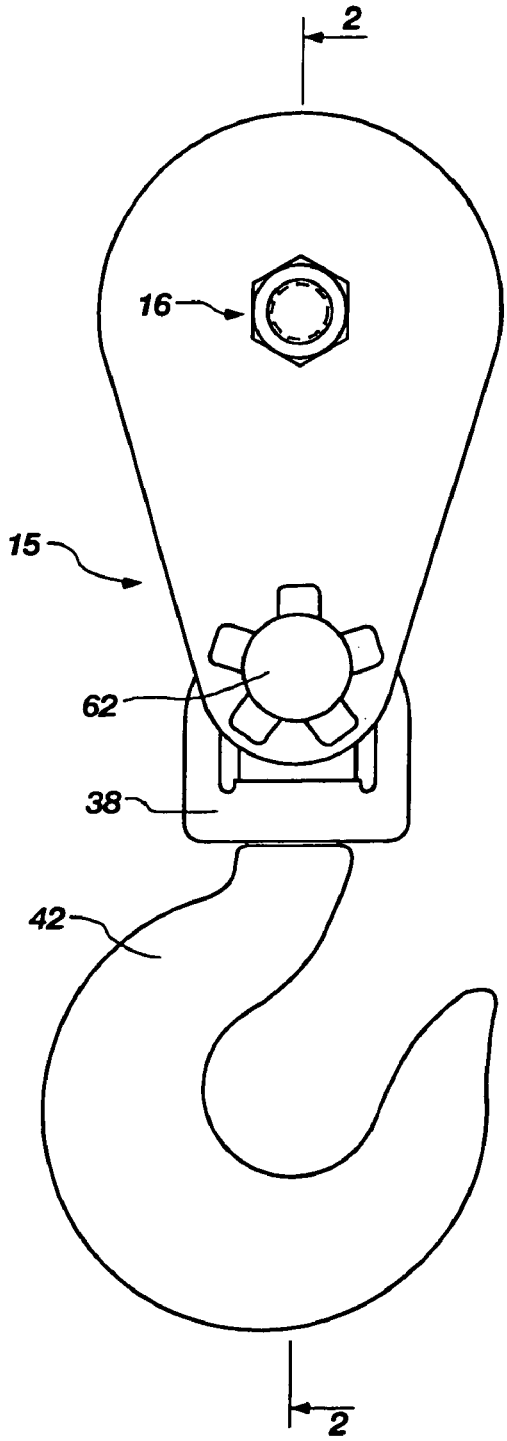
FIG. 2A (PRIOR ART)
FIG. 2A is a side view of a conventional snatch block.
Figure 2B:
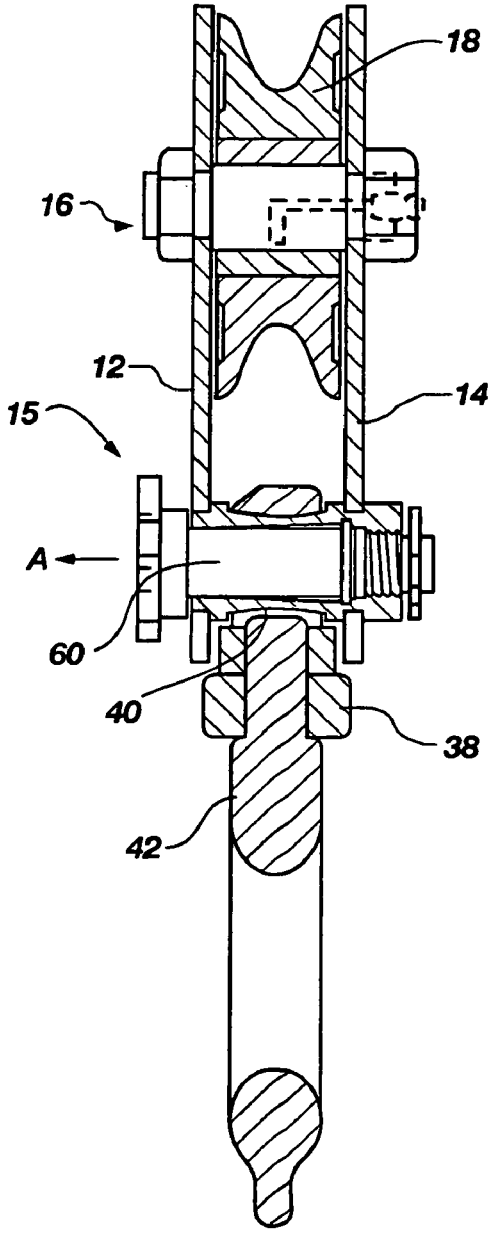
FIG. 2B (PRIOR ART)
FIG. 2B is a cross-sectional view taken along line 2—2 of FIG. 2A.
Figure 3:
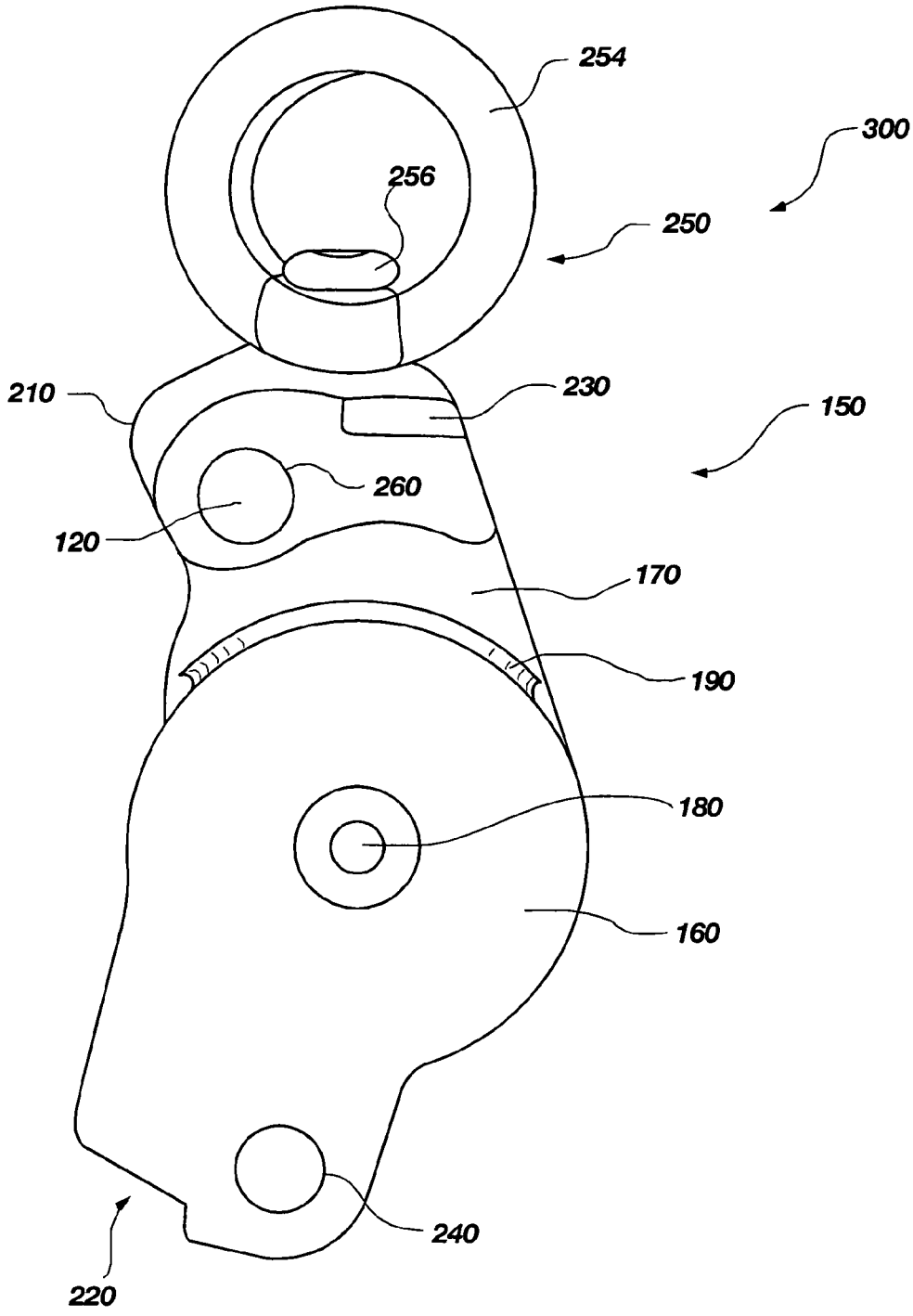
FIG. 3 illustrates an exemplary embodiment of a snatch block assembly of the present invention.
Figure 4:
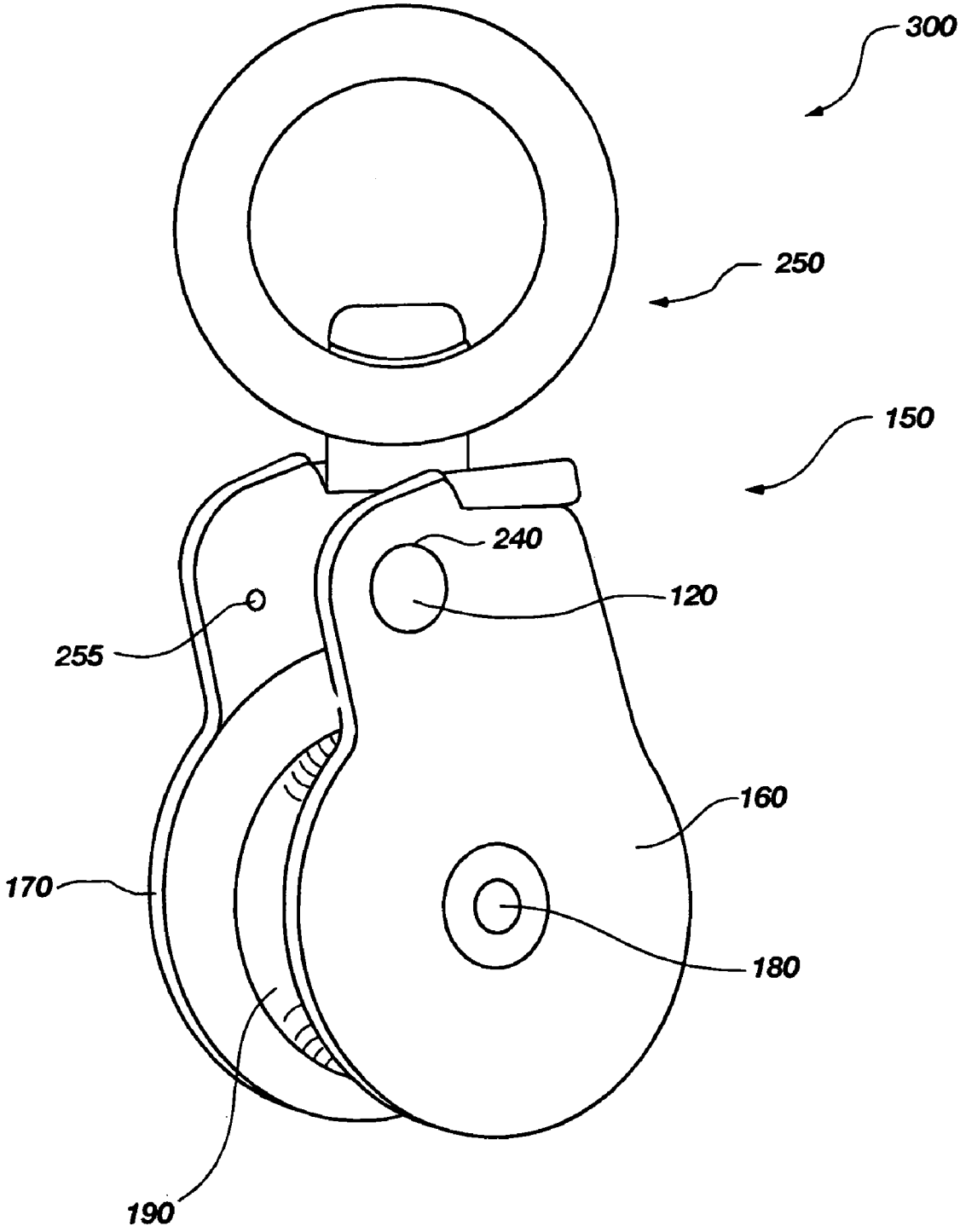
FIG. 4 depicts another view of the snatch block assembly of FIG. 3.

One exemplary embodiment of a snatch block 150 according to the present invention is depicted in FIG. 3. The snatch block 150 includes a first sideplate 160 and a second sideplate 170 oriented substantially parallel thereto, the first and second sideplates 160 and 170 spaced apart by a pin 180. The second sideplate 170 is secured to an assembly head 210. The first sideplate 160 is mounted to pivot with respect to the assembly head 210 about the pin 180. The snatch block 150 is shown in FIG. 3 with the first sideplate 160 in an open position, enabling a bight of rope (not shown) to be inserted. FIG. 4 depicts the snatch block 150 with the first sideplate 160 in a closed position. In the closed position of snatch block 150 as shown in FIG. 4, a retaining device or mechanism shown schematically as a button 120, engages the first sideplate 160, preventing the first sideplate 160 from returning to the open position unless the retaining device is disengaged by a user. The retaining device may be a quick-release device, such as a device that requires only a single motion of a user's hand for disengagement, followed by rotation of first sideplate 160. One example of a quick-release device is a button 120 that is spring-loaded toward first sideplate 160 in a direction transverse to the planes of the first sideplate 160 and the second sideplate 170. The button 120 is configured to engage with an aperture 240 located in the first sideplate 160, retaining the first sideplate 160 in position with respect to the second sideplate 170 and the assembly head 210.

Figure 5:
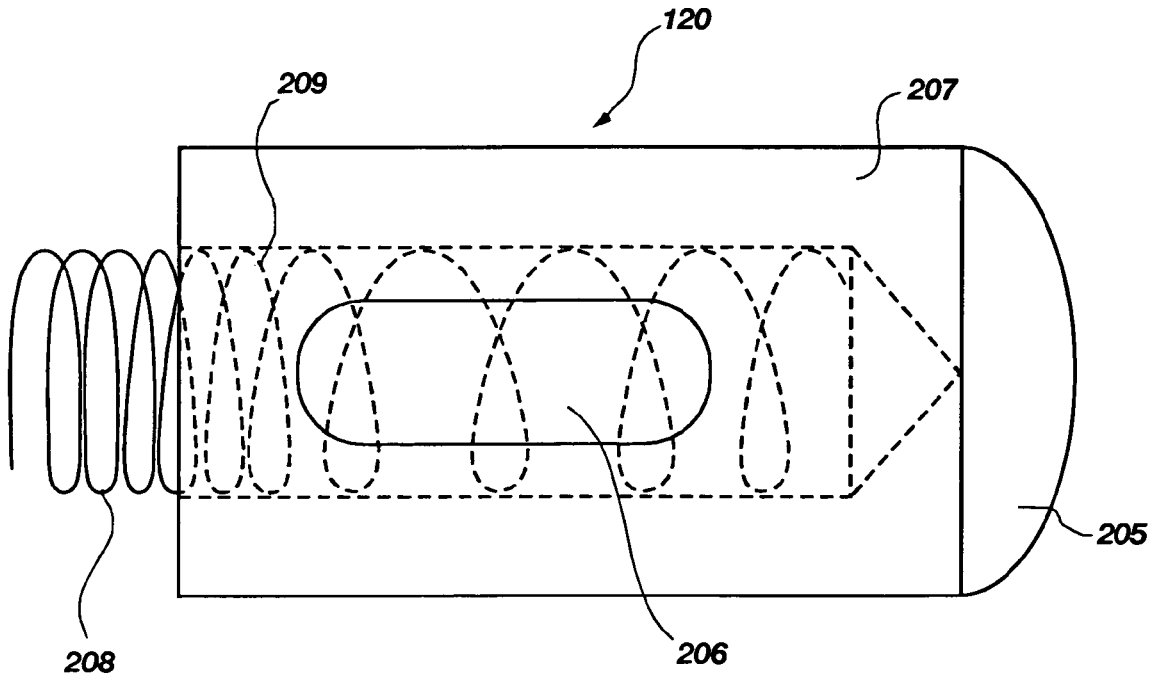
FIG. 5 depicts the button of the snatch block assembly of FIG. 3.

The button 120, shown in more detail in FIG. 5, may be partially housed, for example, within a cavity 260 of the assembly head 210 (FIG. 3). A distal end 205 of the button 120 is biased to protrude from the cavity 260 to engage the first sideplate 160. The body 207 of the button 120 is depicted as cylindrical, with a circular cross-section, but may be of any shape. For example, the button 120 may have an elliptical or even polygonal cross-section. The distal end 205 may be chamfered or rounded (as shown), enabling the first sideplate 160 to move thereover after contact therewith as first sideplate 160 pivots with respect to the pin 180 and easily return to the closed position, as well as for the comfort of a user and to minimize the potential for snagging on ropes and clothing or other fabric structures such as safety belts and harnesses. The body 207 of the button 120 may include a slot 206 configured to engage with a set screw 255 (FIG. 4) protruding inwardly from the assembly head 210 and transverse to a longitudinal direction of movement of body 207. The slot 206 and the set screw 255 limit the axial and rotational movement of the button 120.

The button 120 may be, for example, a spring-loaded or otherwise resiliently biased body. A spring 208 may be located in assembly head 210 proximally of body 207 and a portion thereof may extend distally within an opening 209 located in a proximal end of the body 207 of button 120. The spring 208 urges the button 120 axially outwardly from the cavity 260 to engage the aperture 240 (FIG. 3) of the first sideplate 160. The spring 208 may be compressed by a force applied to the distal end 205 of the button 120, for example by a thumb or finger of the user. In such an instance, the button 120 may be moved along its longitudinal axis to be substantially entirely housed within the cavity 260 of the assembly head 210, disengaging the aperture 240 of the first sideplate 160, and enabling the first sideplate 160 to pivot with respect to the second sideplate 170. By way of a specific and nonlimiting example, a user may grasp the first sideplate 160 at sides thereof using the thumb and a finger of the same hand, such as the third finger, depress button 120 with the index finger of the same hand, and rotate or pivot the first sideplate 160 in a first direction with a turn of the wrist to an open position. A bight of rope may be inserted between the first and second sideplates 160 and 170 and over sheave 190 (FIG. 3), and the first sideplate 160 then grasped as before and rotated in the opposing direction to a closed position until engaged by button 120.

It should be noted that other configurations for the spring-biasing button 120 may be employed. For example, the cavity 260 in assembly head 210 may extend completely therethrough, with the end proximate first sideplate 160 being constrained to prevent movement of body 207 therethrough; in such an instance, body 207 having an annular shoulder surrounding and slightly proximal of distal end 205 to provide a stop against the assembly head 210 at the distal end of cavity 260. A spring 208 may then be placed behind body 207, and the cavity 260 closed behind the spring 208 such as, for example, by a threaded end cap.

Returning to FIGS. 3 and 4, the assembly head 210 may optionally include a protrusion 230 extended toward the first sideplate 160, creating a stop for the rotational movement of the first sideplate 160 when the retaining device or mechanism is aligned for engagement with the first sideplate 160. The first sideplate 160 may include an indentation 220 for engaging with the protrusion 230 when pivoted to the closed position. For example, as shown in FIG. 4, as protrusion 230 engages the indentation 220, aperture 240 of the first sideplate 160 is aligned with the button 120.

A sheave 190 may be positioned between the first sideplate 160 and the second sideplate 170. The sheave 190 may be rotatably or fixedly mounted on the center pin 180, and rotate with or about the center pin 180. The center pin 180 may comprise a structure forming an axle such as a bolt, screw, pin, rod, and the like. A bearing (not shown) may be provided between the sheave 190 and the center pin 180. A rope (not shown) extending through the snatch block 150 around sheave 190 may place a load on the snatch block 150. The retaining device, such as the button 120 of FIGS. 3 and 4, may additionally provide structural support for the first sideplate 160, distributing any load placed on the snatch block 150 between the first sideplate 160 and the second sideplate 170. The snatch block 150 may be configured to conform to CE (Committee for European Normalization), UIAA (Union International des Associations d' Alpinism), NFPA (National Fire Protection Agency), ANSI (American National Standards Institute), and OSHA (Occupational Safety and Health) standards. For example, the snatch block 150 may be structured to meet the NFPA minimum breaking strength of 8,000 lbs. (36.0 kN).

An exemplary snatch block assembly 300 according to the present invention includes the snatch block 150 and an attachment device 250. The attachment device 250 enables the snatch block assembly 300 to be connected to an anchor point, such as another structure, a tree, a rock, etc. The attachment device 250 is depicted to include a ring 254, however an attachment device including a hook, a shackle, or the like is encompassed within the scope of the invention. The attachment device 250 may be configured to swivel about an axis of rotation other than that of the sheave 190 of the snatch block 150, for example, substantially transverse thereto. The swivel action may prevent ropes used in rigging activities in conjunction with snatch block assembly 300 from becoming twisted. The attachment device 250 is independent from the opening mechanism of the snatch block 150, enabling the snatch block 150 to be opened for rope insertion while the snatch block assembly 300 is connected to an anchor point. The swivel feature enables the sheave 190 to be properly positioned to receive a rope bight, even after the snatch block assembly 300 has been connected to the anchor point.

Figure 10:
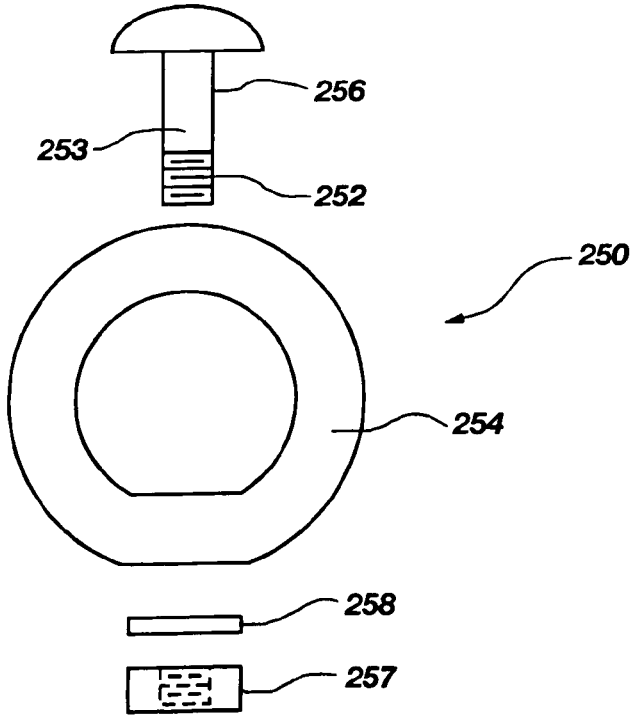
FIG. 10 depicts an exploded view of an exemplary embodiment of an attachment device of the snatch block assembly of FIG. 3.

FIG. 10 depicts an exploded view of an exemplary attachment device 250. The ring 254 may be joined with the assembly head 210 (FIG. 3) using a bolt 256 received through an aperture (not shown) in the assembly head 210. The threaded portion 252 of the bolt 256 may be secured within the assembly head 210 using a nut 257 (such as a lock nut) or a threaded bore in assembly head 210 provided with a locking structure to prevent bolt 256 from backing off. A washer 258 may separate the assembly head 210 from the ring 254, or may be placed between the head of bolt 256 and ring 254 to act as a bearing therebetween. The ring 254 may swivel about the shaft 253 of the bolt 256. An attachment device including other methods of rotatably or fixedly joining the ring 254 with the assembly head 210 are within the scope of the invention. For example, the bolt 256 may be positioned with a head of the bolt 256 within the assembly head 210 and secured with a threaded bore in the ring 254. Optionally, a rivet may be used to join the ring 254 with the assembly head 210.

The components of the snatch block assembly 300 may be formed of, for example, aluminum, aluminum alloy, nickel-plated aluminum, steel, or titanium. The second sideplate 170 and the assembly head 210 may be integrally formed by machining from a solid piece of metal, creating a single, contiguous metal structure. The second sideplate 170 and the assembly head 210 may alternatively be formed separately, and attached by suitable methods. Other components may also be formed by machining. Some components may alternatively be formed by bending metal, extrusion, or other suitable methods.

Figure 6:
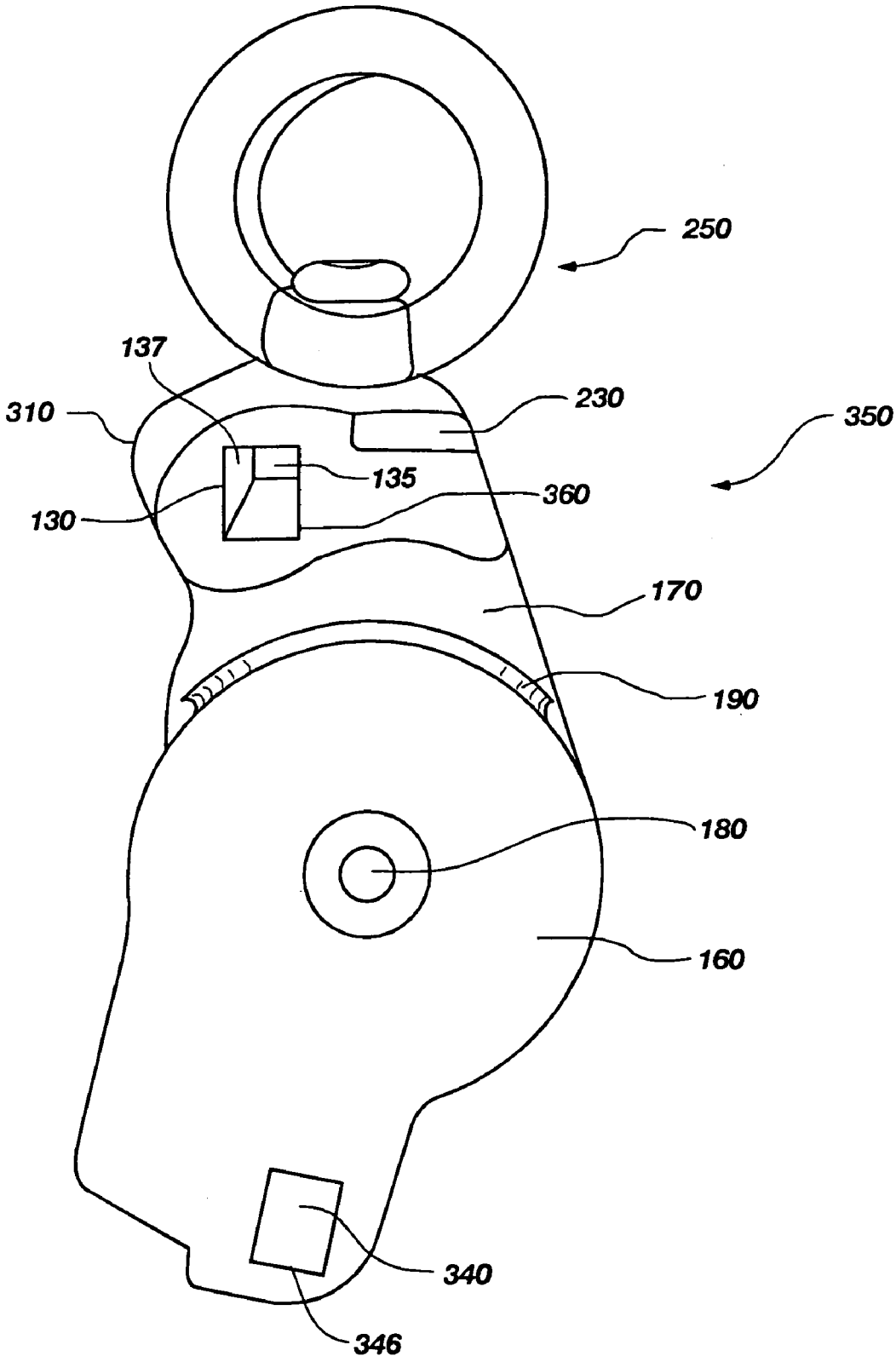
FIG. 6 illustrates another exemplary embodiment of a snatch block assembly of the present invention.
Figure 7:
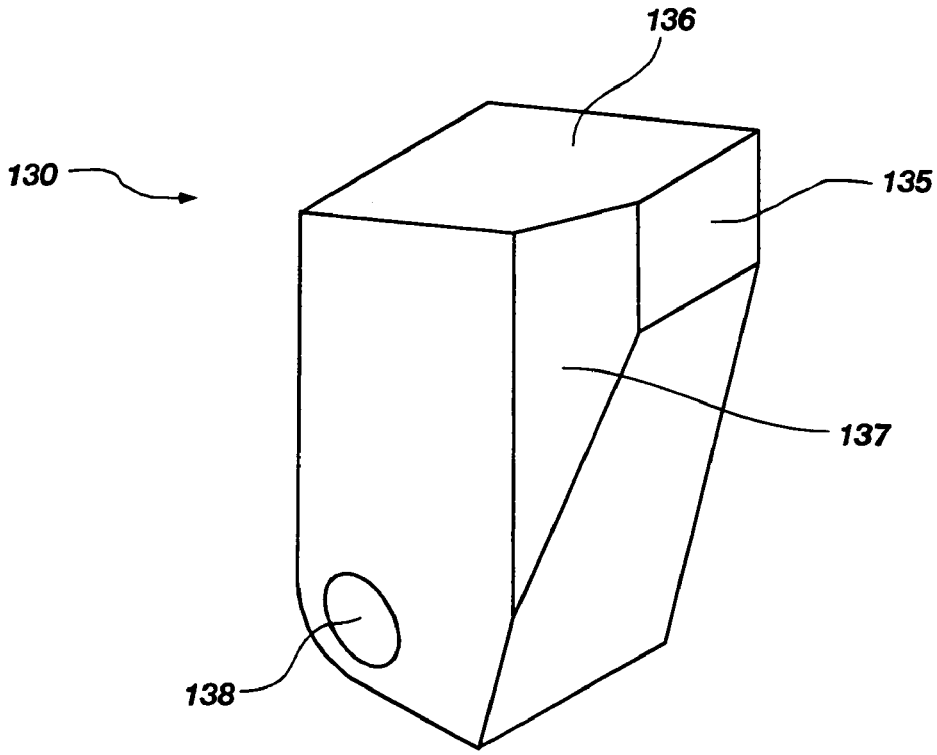
FIG. 7 depicts the latch of the snatch block assembly of FIG. 6.

Another exemplary embodiment of the present invention is a snatch block 350, illustrated in FIG. 6. The snatch block 350 is substantially similar to the snatch block 150 of FIGS. 3 and 4. However, the retaining device of the snatch block 350 of FIG. 6 comprises a latch 130. The latch 130, shown in more detail in FIG. 7, may be partially housed within a cavity 360 of the assembly head 310 (FIG. 6). An exposed face 135 and an adjoining portion of the latch 130 protrude from the cavity 360, and the protruding portion of the latch 130 is configured to securely engage aperture 340 of the first sideplate 160. The latch 130 may pivot about an axis extending through an aperture 138 of the latch 130. A pin (not shown) may be disposed through aperture 138 and aligned apertures within assembly head 310 flanking cavity 360 to pivotally secure the latch 130 with the assembly head 310. The latch 130 may be pivoted away from first sideplate 160 against a biasing structure such as, for example, a leaf spring, a Belleville spring or a resilient elastomer disposed behind it in cavity 360 by a force applied to the latch's exposed face 135, for example by a thumb or finger of the user. Under such an impetus, the latch 130 pivots inwardly to be substantially entirely housed with the cavity 360 of the assembly head 310, disengaging the aperture 340 of the first sideplate 160, and enabling the first sideplate 160 to pivot rotationally to the side of second sideplate 170 for insertion of a rope bight over sheave 190.

A corner of the latch 130 may be chamfered to form an angled side face 137. The angled side face 137 may enable the first sideplate 160 to be rotationally returned to the closed position without requiring a user to directly contact the latch 130, as the first sideplate 160 may be rotationally wiped or swept over angled side face 137 to move latch 130 inwardly into cavity 360, after which the resilient bias of the latch 130 will cause it to protrude through aperture 340 of first sideplate 160, rotationally locking the latter in a closed position. An upper face 136 of the latch 130 may provide structural support for the first sideplate 160 by engaging a top side 346 of the aperture 340 of the first sideplate 160.

Figure 8:
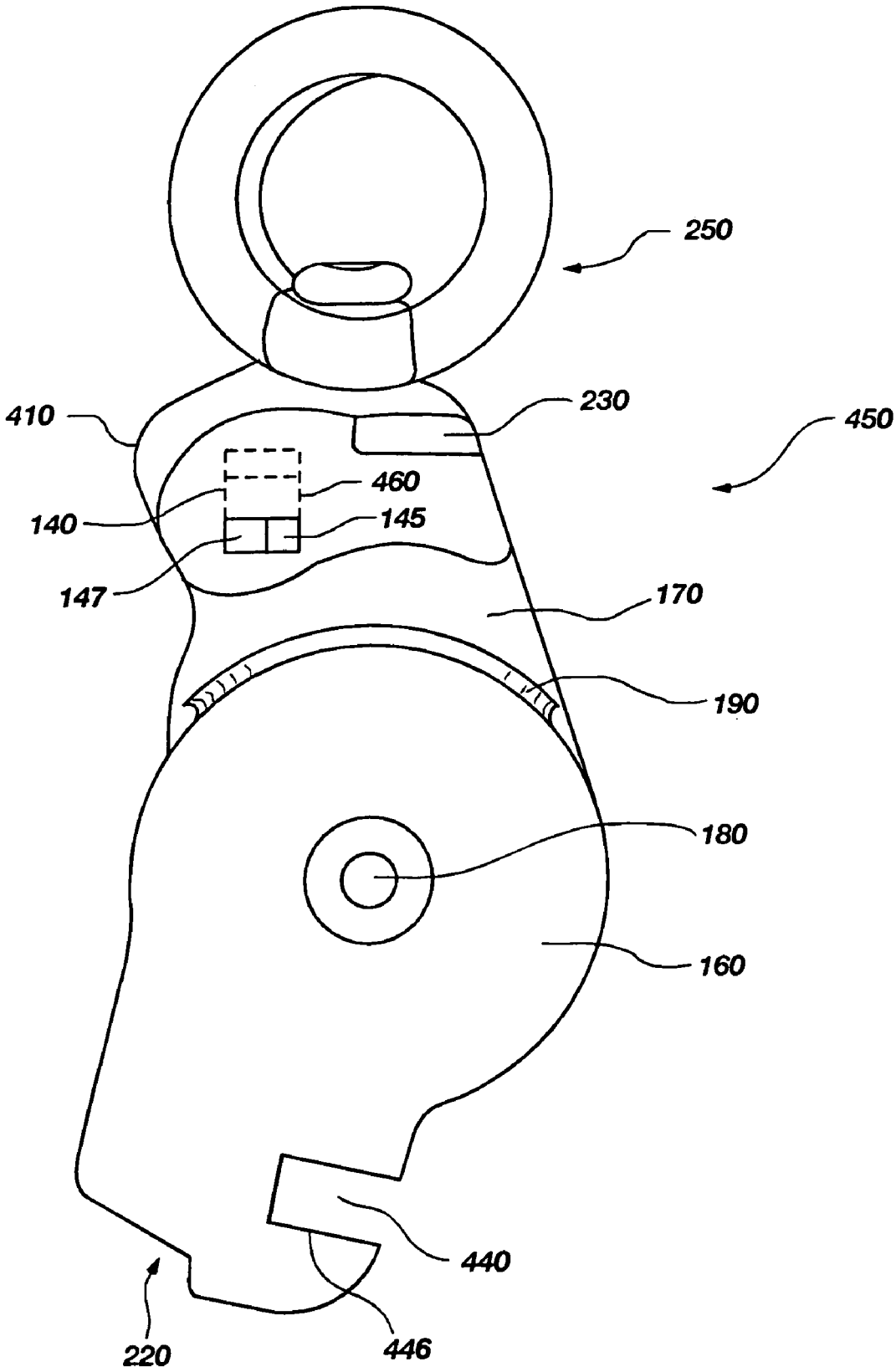
FIG. 8 illustrates yet another exemplary embodiment of a snatch block assembly of the present invention.
Figure 9:
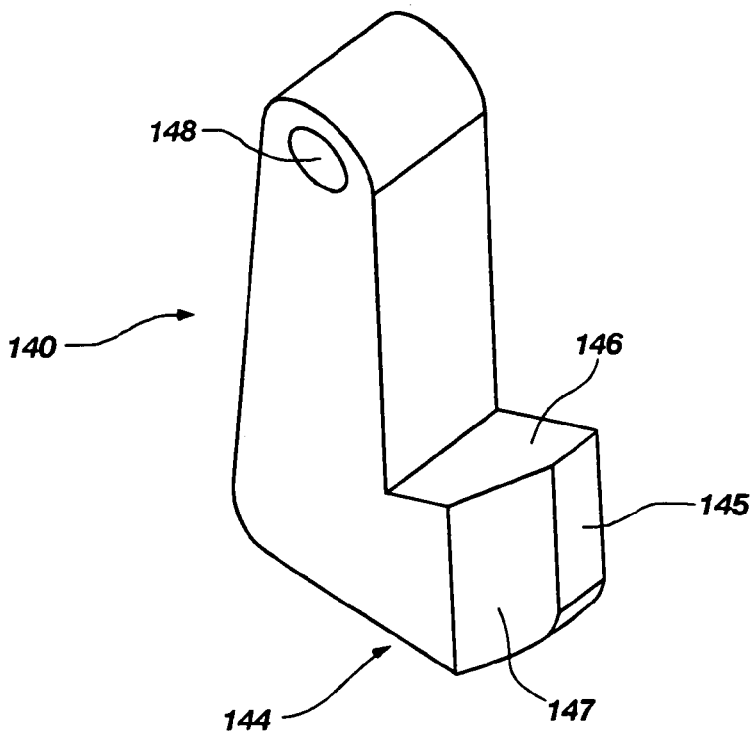
FIG. 9 depicts the latch of the snatch block assembly of FIG. 8.

Yet another exemplary embodiment of the present invention is a snatch block 450, illustrated in FIG. 8. The snatch block 450 is substantially similar to the snatch block 150 of FIGS. 3 and 4, and the snatch block 350 of FIG. 6; however, the retaining device or mechanism of the snatch block 450 of FIG. 8 comprises a hook-shaped latch 140. The hook-shaped latch 140, shown in more detail in FIG. 9, may be partially housed within a cavity 460 of the assembly head 410 (FIG. 8). An exposed face 145 on a hook portion 144 of the hook-shaped latch 140 protrudes from the cavity 460, and the protruding hook portion 144 engages a notch 440 of the first sideplate 160 in its closed position. The hook-shaped latch 140 may pivot about an axis extending through an aperture 148 of the hook-shaped latch 140. A pin (not shown) may pivotally secure the hook-shaped latch 140 with the assembly head 410 in the manner previously described with respect to latch 130 of snatch block 350. The hook-shaped latch 140 may be pivoted by a force applied to the latch's exposed face 145, or any part of the hook portion 144, for example by a thumb or finger of the user, against a resilient bias provided by a spring or other resilient element or structure. The hook-shaped latch 140 pivots inwardly to be substantially entirely housed with the cavity 460 of the assembly head 410, disengaging the notch 440 of the first sideplate 160, and enabling the first sideplate 160 to pivot.

A corner of the hook portion 144 may be chamfered to form an angled side face 147. The angled side face 147 may enable the first sideplate 160 to be returned to the closed position by rotationally sweeping or wiping over the angled side face 147 without requiring a user to directly contact the hook-shaped latch 140. An upper face 146 of the hook portion 144 may provide structural support for the first sideplate 160 by engaging a top side 446 of the notch 440 of the first sideplate 160. Notably, first sideplate 160, in its closed position, is rotationally locked between hook-shaped latch 140 and protrusion 230 of assembly head 410. One of skill in the art will realize that the aperture 240 of the first sideplate 160 shown in FIGS. 3 and 4, and the aperture 340 of the first sideplate 160 shown in FIG. 6 may comprise the notches similar to the notch 440 of the first sideplate 160 shown in FIG. 8. Likewise, the notch 440 may comprise an aperture.

Figure 11:
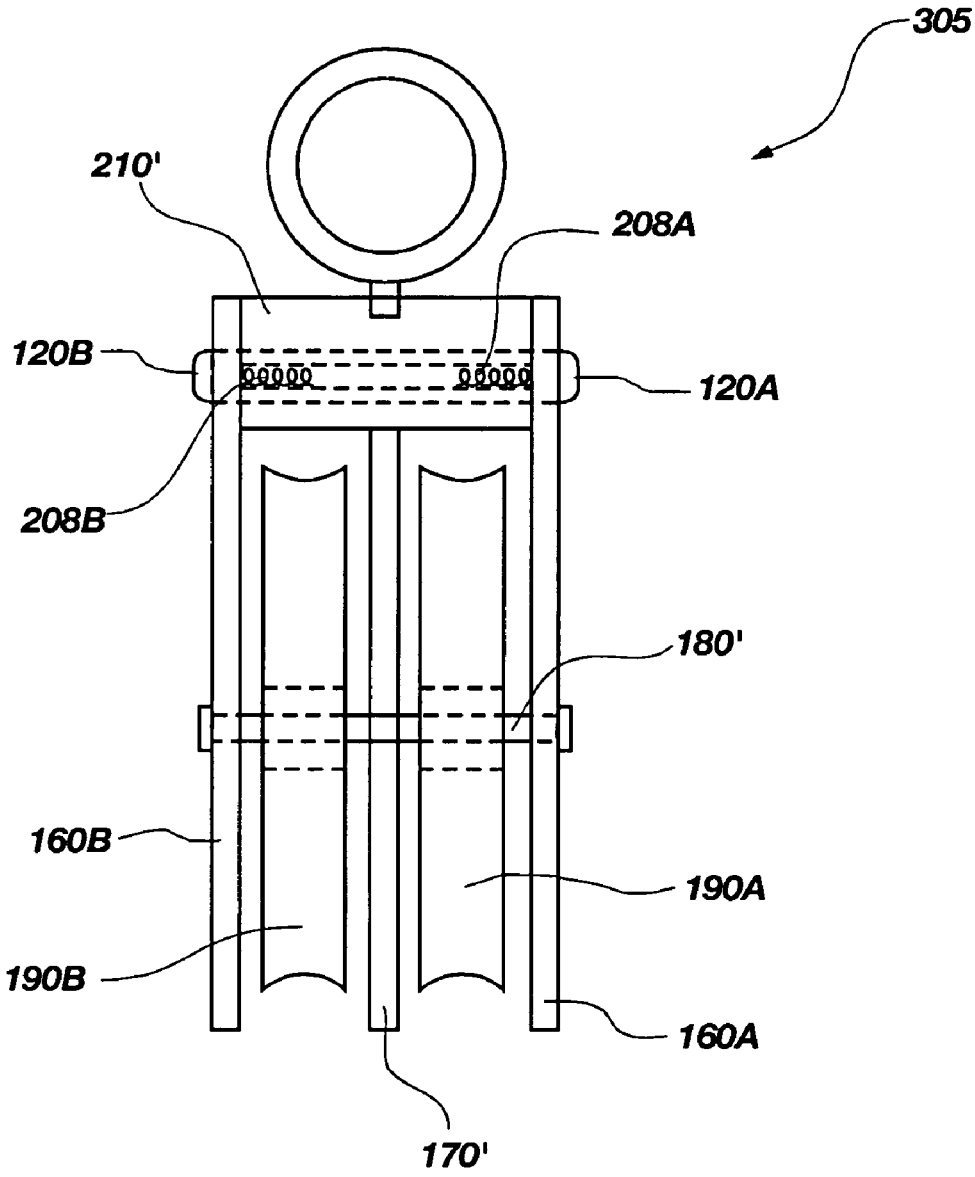
FIG. 11 depicts a side view of still another exemplary embodiment of a snatch block assembly of the present invention.

FIG. 11 depicts a side view of an exemplary embodiment of a double snatch block assembly 305 of the present invention. The double snatch block assembly 305 is configured for two ropes (not shown) to be inserted; one rope on a first sheave 190A and another rope on a second sheave 190B. The first sheave 190A and the second sheave 190B may rotate about a single pin 180'. The first sheave 190A may be positioned between a center plate 170' and a first pivoting sideplate 160A. The second sheave 190B may be positioned between the center plate 170' and a second pivoting sideplate 160B. Each pivoting sideplate 160A, 160B is shown engaged with a retaining device of an assembly head 210'. The first pivoting sideplate 160A is engaged with a first button 120A, urged axially outwardly by a first spring 208A. The second pivoting sideplate 1 60B is engaged with a second button 120B, urged axially outwardly by a second spring 208B. The first button 120A and the second button 120B are orthogonally (perpendicular to the plane of the paper) offset, and do not interfere with one another. The first button 120A may be disengaged from the first pivoting sideplate 160A, enabling the first pivoting sideplate 1 60A to be opened by pivoting about the pin 180'. A rope may be inserted to be carried by the first sheave 190A. The second pivoting sideplate 1 60B may be retained by the second button 120B in the closed position as the first pivoting sideplate 160A is opened.

Although the foregoing description contains many specifics, these are not to be construed as limiting the scope of the present invention, but merely as providing certain exemplary embodiments. Similarly, other embodiments of the invention may be devised which do not depart from the spirit or scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims are encompassed by the present invention.

What is claimed is:

1. A snatch block comprising:

an assembly head;

one sideplate fixed to the assembly head;

a pin projecting from the one sideplate;

at least another sideplate pivotally mounted with respect to the assembly head about the pin, the at least another sideplate having a first surface facing the one sideplate, and a second, opposing surface;

a sheave mounted between the one sideplate and the at least another sideplate for rotation about the pin; and a retaining mechanism comprising a resiliently biased body carried by the assembly head and configured for engaging the at least another sideplate to prevent pivoting thereof, a portion of the retaining mechanism protruding from the second, opposing surface of the at least another sideplate when engaged therewith, the retaining mechanism being further configured to be releasable from engagement with the at least another sideplate with a single motion, the retaining mechanism being substantially entirely housed in the assembly head when released from engagement with the at least another sideplate.

2. The snatch block of claim 1, wherein the assembly head and the one sideplate comprise a contiguous metal material.

3. The snatch block of claim 1, wherein the at least another sideplate includes an aperture configured for engagement with the resiliently biased body when rotationally aligned therewith.

4. The snatch block of claim 1, wherein the at least another sideplate includes a notch configured for engagement with the resiliently biased body when rotationally aligned therewith.

5. The snatch block of claim 1, wherein the resiliently biased body provides structural support for the at least another sideplate when engaged therewith.

6. The snatch block of claim 1, wherein the retaining mechanism comprises a resiliently biased latch configured to pivot about an axis.

7. The snatch block of claim 6, wherein the at least another sideplate includes an aperture configured for engagement with the resiliently biased latch when rotationally aligned therewith.

8. The snatch block of claim 6, wherein the at least another sideplate includes a notch configured for engagement with the resiliently biased latch when rotationally aligned therewith.

9. The snatch block of claim 6, wherein the resiliently biased latch includes a top surface configured to provide structural support for the at least another sideplate when engaged therewith.

10. The snatch block of claim 1, further comprising a protrusion on the assembly head extending toward the at least another sideplate, the protrusion positioned for limiting pivoting movement of the at least another sideplate by contact therewith.

11. The snatch block of claim 1, further comprising yet another sideplate configured for a pivot action with respect to the assembly head about the pin on an opposite side of the one sideplate from the at least another sideplate and an additional sheave mounted between the one sideplate and the yet another sideplate.

12. The snatch block of claim 1, wherein the retaining mechanism and the at least another sideplate are, in combination, configured for release of the retaining mechanism from the at least another sideplate and pivoting of the at least another sideplate after release by a single hand of a user.

13. The snatch block of claim 1, wherein the single motion comprises a substantially linear motion of a digit of a user's hand.

14. The snatch block of claim 1, further comprising an attachment structure secured to the assembly head for rotation about an axis substantially transverse to an axis of rotation of the sheave.

15. A snatch block comprising:

an assembly head;

one sideplate fixed to the assembly head;

a pin projecting from the one sideplate;

at least another sideplate pivotally mounted with respect to the assembly head about the pin;

a sheave mounted between the one sideplate and the at least another sideplate for rotation about the pin; and a retaining mechanism carried by the assembly head and configured for engaging the at least another sideplate to prevent pivoting thereof, the retaining mechanism being further configured to be releasable from engagement with the at least another sideplate with a single motion, and wherein the retaining mechanism comprises a hook-shaped, resiliently biased latch configured to pivot about an axis.

16. The snatch block of claim 15, wherein the at least another sideplate includes an aperture configured for engagement with the hook-shaped resiliently biased latch when rotationally aligned therewith.

17. The snatch block of claim 15, wherein the at least another sideplate includes a notch configured for engagement with the hook-shaped resiliently biased latch when rotationally aligned therewith.

18. The snatch block of claim 15, wherein the hook-shaped resiliently biased latch includes a protruding hook portion configured to provide structural support for the at least another sideplate when engaged therewith.

19. A snatch block comprising:

an assembly head;

one sideplate fixed to the assembly head;

a pin projecting from the one sideplate;

at least another sideplate pivotally mounted with respect to the assembly head about the pin;

a sheave mounted between the one sideplate and the at least another sideplate for rotation about the pin;

a retaining mechanism carried by the assembly head and configured for engaging the at least another sideplate to prevent pivoting thereof, the retaining mechanism being further configured to be releasable from engagement with the at least another sideplate with a single motion; and a protrusion on the assembly head extending toward the at least another sideplate, the protrusion positioned for limiting pivoting movement of the at least another sideplate by contact therewith, and wherein the at least another sideplate includes an indentation configured for contact with the protrusion on the assembly head.

20. A snatch block assembly, comprising:

an assembly head;

one sideplate fixed to the assembly head;

a pin projecting from the one sideplate;

at least another sideplate configured for a pivot action with respect to the assembly head about the pin;

a sheave mounted between the at least another sideplate and the one sideplate for rotation about the pin;

a resiliently biased retaining mechanism carried by the assembly head and configured for engaging the at least another sideplate to prevent the pivot action, and for providing structural support for the at least another sideplate when engaged therewith; and an attachment structure secured to the assembly head for rotation about an axis substantially transverse to an axis of rotation of the sheave.

21. A method of opening a snatch block, comprising:

providing a snatch block comprising:

an assembly head;

one sideplate fixed to the assembly head;

a pin projecting from the one sideplate;

a retaining mechanism carried by the assembly head; and at least another sideplate attached to the pin and engaged by the retaining mechanism under a resilient bias, the at least another sideplate having a first surface facing the one sideplate, and a second, opposing surface, a portion of the retaining mechanism protruding from the second, opposing surface of the at least another sideplate when engaged therewith;

urging substantially all of the retaining mechanism against the resilient bias into a cavity in the assembly head to disengage the at least another sideplate; and pivoting the at least another sideplate about the pin.

22. The method of claim 21, further comprising:

allowing the portion of the retaining mechanism to protrude from the cavity under the resilient bias;

pivoting the at least another sideplate back into alignment with the retaining mechanism, sweeping the at least another sideplate over the retaining mechanism against the resilient bias; and permitting the retaining mechanism to lockingly engage the at least another sideplate under the resilient bias.

23. The method of claim 21, further comprising effecting the urging and pivoting with a single hand of a user.

* * * * *

UNITED STATES PATENT AND TRADEMARK OFFICE

CERTIFICATE OF CORRECTION

PATENT NO. : 7,168,687 B2
APPLICATION NO. : 10/977320
DATED : January 30, 2007
INVENTOR(S) : Rocke P. Thompson It is certified that error appears in the above-identified patent and that said Letters Patent is hereby corrected as shown below:

On the title page:

In ITEM (73) Assignee: change "Techxotic LC," to --Techxotic, LC,--

In the specification:

| | | |
|---|---|---|
| COLUMN 7 | LINE 36 | change "sideplate **1 60**B" to --sideplate **160**B-- |
| COLUMN 7 | LINE 43 | change "sideplate **1 60**A" to --sideplate **160**A-- |
| COLUMN 7 | LINE 45 | change "sideplate **1 60**B" to --sideplate **160**B-- |

Signed and Sealed this
Eighth Day of March, 2011

David J. Kappos

David J. Kappos
*Director of the United States Patent and Trademark Office*